US011230432B2

(12) United States Patent
Georgievich

(10) Patent No.: US 11,230,432 B2
(45) Date of Patent: Jan. 25, 2022

(54) LARGE SOFT CONTAINER

(71) Applicant: Rabizo Ivan Georgievich, Kharkov (UA)

(72) Inventor: Rabizo Ivan Georgievich, Kharkov (UA)

( * ) Notice: Subject to any disclaimer, the term of this patent is extended or adjusted under 35 U.S.C. 154(b) by 15 days.

(21) Appl. No.: 16/089,148

(22) PCT Filed: May 3, 2017

(86) PCT No.: PCT/UA2017/000056
§ 371 (c)(1),
(2) Date: Sep. 27, 2018

(87) PCT Pub. No.: WO2017/171691
PCT Pub. Date: Oct. 5, 2017

(65) Prior Publication Data

US 2019/0119039 A1 Apr. 25, 2019

(30) Foreign Application Priority Data

Apr. 1, 2016 (UA) ..... a 2016 03380

(51) Int. Cl.
*B65D 88/16* (2006.01)
*B65D 90/06* (2006.01)
*B65D 88/54* (2006.01)

(52) U.S. Cl.
CPC ..... *B65D 88/16* (2013.01); *B65D 88/1618* (2013.01); *B65D 88/1625* (2013.01); *B65D 88/1668* (2013.01); *B65D 88/1681* (2013.01); *B65D 88/54* (2013.01); *B65D 90/06* (2013.01); *B65D 2588/16* (2013.01)

(58) Field of Classification Search
CPC .... B65D 33/02; B65D 88/16; B65D 88/1618; B65D 88/1625; B65D 88/1668; B65D 88/1681; B65D 88/54; B65D 90/06; B65D 2588/16
USPC ..... 220/9.1
See application file for complete search history.

(56) References Cited

U.S. PATENT DOCUMENTS 4,113,146 A * 9/1978 Williamson ..... B65D 88/1618 222/105
4,194,652 A * 3/1980 Williamson ..... B65D 88/1612 112/418
2009/0277900 A1* 11/2009 Howison ..... B65D 90/0033 220/1.6

* cited by examiner

*Primary Examiner* — James N Smalley
*Assistant Examiner* — Madison L Poos
(74) *Attorney, Agent, or Firm* — Inventa Capital PLC

(57) ABSTRACT

The device relates to transportation and storage of bulk cargoes and comprises a vessel with upper charging opening and lower discharging opening, bearing framework and discharging mechanism, the device being further provided with soft sling load distribution ring, which passes through additional external loops of the main slings and alternately through additional loops along the upper perimeter of the cylinder, which, in turn, are embodied in the form of the load distribution triangle. The device provides improving convenience of handling multi-tonnage bulk cargoes as well as improving container reliability in use.

3 Claims, 2 Drawing Sheets

LARGE SOFT CONTAINER

The invention relates to transportation field and can be used for storage of bulk cargoes, such as bulk building materials, raw materials for metallurgy industry, chemical industry products, raw sugar, grain, coffee and other food products.

There is known a soft container for transportation and storage of cargoes (Patent RU 2228287, published on 10 May 2004), which comprises a sleeve and bottom. The container bottom is formed by four long petals bent from outside to the center and connected with the sleeve and four short petals located between the long petals. The short petals are located above the long petals overlaid against each other and drawn to the center of the bottom with rope member, and specifically the side edges of each short petal are stitched on above the long petals adjacent to it for the length providing tightness of the bottom in the places of connection of the petals for the case of their maximum possible opening during container discharging. The disadvantage of such design is its low reliability.

The soft container for transportation and storage of bulk cargoes (Patent of Ukraine for invention No. 72054, published 15 Jul. 2003) is the closest to the claimed invention by its technical essence, purpose and achieved result. It comprises a vessel with upper filling opening and lower discharging opening, and bearing framework. The invention also contains a locking device, bearing net with lifting loops and with bottom. According to this known invention, the vessel is disposed in the bearing net and connected with it in the upper part by means of detachable joint consisting of loops successively connected with each other and fastened to the vessel and to the bearing net, with closing of the last group of the loops by means of tie-up string. In particular, the extension of the loops fastened to the vessel is embodied in the form of tapes disposed under angle to direction of threads forming warp and weft of the vessel fabric, the bearing net has a bottom with opening and rim member connected with vessel discharge opening, the vessel is provided with sleeves having tape loops for strangling and system of valves, and one of the valves is fastened on the vessel filling opening.

The main disadvantage of the known device is that it is inconvenient in use. It is due to the following causes. The container consists of two parts: bearing framework in the form of net and internal insert which is fastened in its upper part to the bearing framework in detachable way.

In addition, this device is unreliable in use. The vessel is fixed only at the expense of passing the sling tapes through the tunnel. This method is efficient only for the main part of the vessel (insert), but, when the large soft container is transported in the folded condition, the lower its part, in particular the discharge valve, shall remain in the center of intersection if the sling tapes on the bottom, or else, if the central discharging valve is displaced from the discharge opening, the discharge may simply fail.

Besides, this known container has the sling structure protected from damage with the help of protective tunnels, but the transverse rings are located outside and are very sensitive to damage since they are not protected. The known container has protective jacket on the bag bottom.

In addition, it follows from the known patent that transverse rings are attached with the fixing tie-up tape sewn to the protective tunnel. Since the tape is sewn to material, its integrity and tightness is disturbed due to punching openings in the material with needles. Thus, there exists a high probability that during use the tape may tear off, just leaving a hole in the material.

Further, in the known container, the bottom of sling net is formed by intersection of main sling tapes. The fact is that, for forming a bottom capable to withstand multi-tonnage cargo, such intersection is insufficient since it is very small and has no rigid adhesion of tapes, without which the sling structure being under pressure of cargo will always go apart with its tapes taking different positions.

This invention is intended for solving the task of improving convenience of container use during handling multi-tonnage bulk cargoes, as well as improving reliability of the container during its use.

The set task is solved in that the large soft container comprises a vessel with upper charging opening and lower discharging opening, bearing framework and discharging mechanism. According to the invention, the device is additionally provided with soft sling ring for distribution of loads, which is passed through additional external loops of the main slings and alternately through additional loops on the upper perimeter of the cylinder, which, in turn, are embodied in the form of the load distribution triangle.

According to one of the embodiments of the invention, the container is additionally provided with protective jacket, which protects the entire surface area of the cylinder and bottom and is attached along the upper perimeter of the cylinder by means of detachable connection.

According to further embodiment of the invention, all the loops for connecting the cylinder with the sling structure are embodied in the form of the load distribution triangle.

According to one more embodiment of the invention, the bottom of the bearing framework is formed by intersection of sling tapes and has reinforced transverse tapes, with retention of dimensions between the tapes which connect these additional sling tapes forming at least one octagon between them.

According to one more embodiment of the invention, the bottom of the bearing structure is fastened to the bottom of the cylinder to prevent displacement of the container bottom.

According to additional embodiment of the invention, the transverse rings are fixed with tunnel detachable connection.

According to the invention, the set task of improving convenience of use is solved in that the offered device is additionally provided with additional loops for fixing the bottom of the cylinder to the main sling structure which excludes displacement of the neck from the discharging place, even after transportation of the container in empty folded condition.

Besides, improving reliability of the container is also promoted by the fact that the protective jacket is fastened along the entire perimeter of the cylinder in its upper part. For this purpose, a collar with detachable connection system is welded along the perimeter of the cylinder in its upper part. Along the entire perimeter of the outer jacket, a detachable connection system is also provided, and thanks to it they are connected. The connection is provided with the use of the following principle, the main cylinder with sling structure is pulled into external jacket embodied in the form of a cylinder with open top provided with fastening system and bottom with discharging valves, and is fixed along the upper perimeter by means of the collar with fastening system.

In the offered embodiment of the container, instead of fastening sewn tapes, there is used a transverse tunnel with detachable clasp which is welded to the longitudinal tunnel by heat-sealing method, which remains integrity of the structure.

In the offered container of the bottom of sling structure is provided by intersections of the main tapes, these tapes are reinforced with transverse tapes forming at least one octagon, these tapes also having transverse tapes between them which prevent their going apart under load. The bottom of the sling structure has a strong transverse system of fastening the tapes to each other.

The reliability is also improved due to the fact that the protective jack has the height of the internal cylinder and repeats its shape both for the bottom and the entire space. Therefore, the external protective jacket protects the container from damage both on the bottom and over the entire surface.

Such fastening triangles are disposed in the upper part of the cylinder in the places of going the sling tape, as well as on the cylinder between sling tapes.

The invention is illustrated by the following drawings, where

Figure 1:
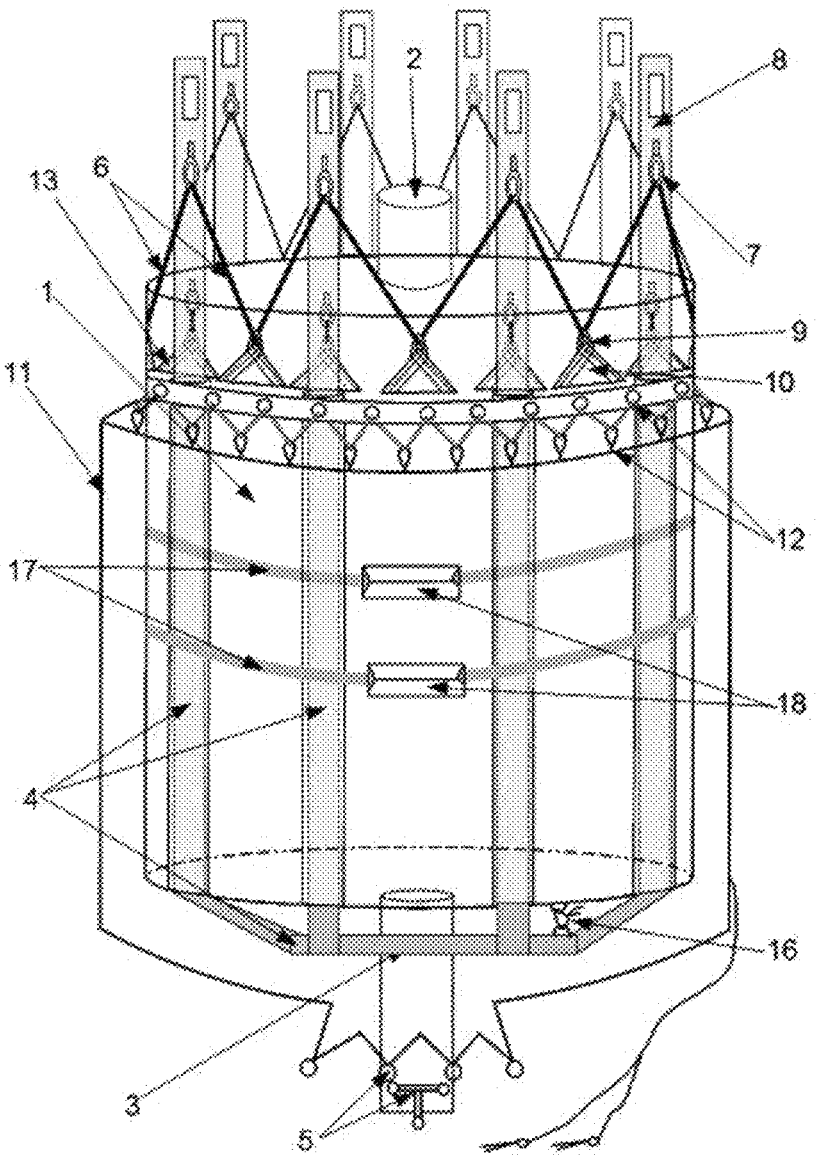
FIG. 1 shows the general view.
Figure 2:
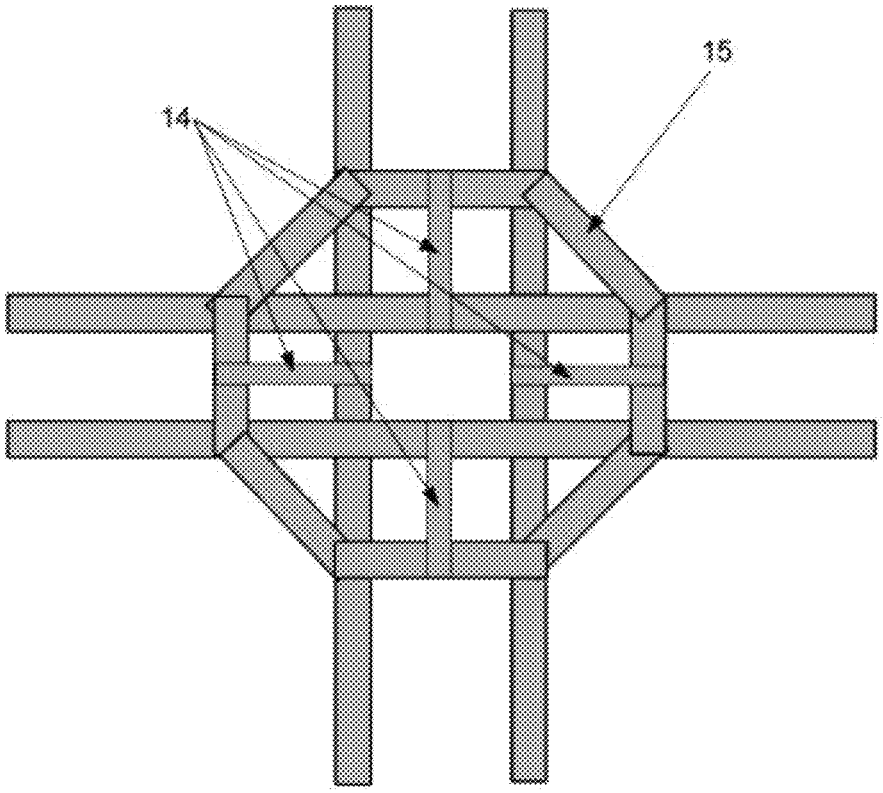
FIG. 2 shows a separate view of sling structure.

The container has such main parts (FIG. 1 & FIG. 2): vessel 1 with upper charging opening 2 and lower discharging opening 3, bearing framework 4, discharging mechanism 5, soft sling ring for distribution of loads 6, which is passed through additional external loops 7 of main slings 8 and alternately through additional loops, on the upper perimeter of cylinder 9, which, in turn, are embodied in the form of load distribution triangle 10. The protective jacket 11 protects the entire surface area of cylinder and bottom and is fastened along the upper perimeter of the cylinder with the help of detachable connection 12. All the loops of connection of the cylinder with sling structure are embodied in form of the load distribution triangle 13. The bottom of the bearing framework is formed with the help of interception of the sling tapes, has reinforced transverse tapes 14, with retention of dimensions between the tapes connecting these additional sling tapes which form at least on octagon 15 between them. The bearing structure bottom is fastened to the bottom of cylinder 16 to prevent displacement of the container. The transverse rings 17 are fixed with tunnel detachable connections 18.

The device is used as follows. The soft container for transportation and storage of bulk cargoes is used according to the known procedure: charging, transportation to the user, discharging. Before charging bulk cargo, it is necessary to check if discharging opening 3 is closed with the help of discharging mechanism 5. Further the container is lifted, being hung on main slings 8, and charging opening 2 is connected with the bulk-cargo hopper. Prior to discharging, it is necessary to unlock discharging mechanism 5. After this, lower discharging opening 3 is released, through which the bulk cargo is discharged from the container.

Thus the invention provides solution of the task aimed at improving convenience of work with multi-tonnage bulk cargoes, as well as improving reliability of the container during use.

The invention claimed is:

1. A large soft container, comprising:

a vessel with an upper charging opening and a lower discharging opening, a cylinder, a bearing framework, a discharging mechanism, a main sling with external loops, and a soft sling load distribution ring, passed through the additional external loops of the main slings and alternately through additional loops along the upper perimeter of the cylinder, which, in turn, are embodied in the form of a load distribution triangle.

2. The large soft container of claim 1, including a protective jacket to protect an entire surface area of the cylinder fastened along the upper perimeter of the cylinder with the help of a detachable connection.

3. A large soft container, comprising:

a vessel with an upper charging opening and a lower discharging opening, a cylinder, a bearing framework, a discharging mechanism, a main sling with external loops, a soft sling load distribution ring passed through the additional external loops of the main slings and alternately through additional loops along an upper perimeter of the cylinder embodied in the form of a load distribution triangle, a protective jacket for protecting an entire surface area of the cylinder fastened along an upper perimeter of the cylinder by a detachable connection, wherein a bottom of the bearing framework is formed with the help of intersection of sling tapes and has reinforced transverse tapes with retention of dimensions between the sling tapes which forming at least one octagon between the sling tapes, and the bottom of the bearing structure connected with the bottom of the cylinder to prevent displacement of the bottom of the container, wherein the transverse rings are fixed by tunnel detachable connections.

* * * * *